US005544795A

United States Patent [19]

Perrin

[11] Patent Number: 5,544,795

[45] **Date of Patent: *Aug. 13, 1996**

[54] SHOCK ABSORBING SHOULDER STRAP

[76] Inventor: Stephen J. Perrin, 2542 Yucca Dr., Camarillo, Calif. 93010

[ * ] Notice: The term of this patent shall not extend beyond the expiration date of Pat. No. 5,450,995.

[21] Appl. No.: 513,542

[22] Filed: Aug. 10, 1995

Related U.S. Application Data

[63] Continuation of Ser. No. 147,332, Nov. 3, 1993, Pat. No. 5,450,995.

[51] Int. Cl.[6] ..... A45F 3/14

[52] U.S. Cl. ..... 224/254; 224/258; 224/264; 224/613; 224/617

[58] Field of Search ..... 224/150, 202, 224/205, 209, 254, 257–259, 264; 206/315.3; 150/107, 108; 383/6, 12, 13, 17, 25

[56] References Cited

U.S. PATENT DOCUMENTS

| | | | |
|---|---|---|---|
| 3,087,277 | 4/1963 | McCook | 224/205 |
| 3,317,098 | 5/1967 | Auraen | 224/254 |
| 4,260,088 | 4/1981 | Buckner | 224/202 |
| 4,337,938 | 7/1982 | Rodriguez | 224/258 |
| 4,431,041 | 2/1984 | Leiserson | 224/264 |
| 4,754,858 | 7/1988 | Robinson | 224/264 |
| 5,042,704 | 8/1991 | Izzo | 224/209 |
| 5,184,764 | 2/1993 | Orovan et al. | 224/209 |
| 5,269,449 | 12/1993 | Sattler | 224/258 |
| 5,318,209 | 6/1994 | Rader et al. | 224/264 |
| 5,326,175 | 7/1994 | Carter | 383/22 |

*Primary Examiner*—J. Casimer Jacyna
*Attorney, Agent, or Firm*—Lyon & Lyon

[57] ABSTRACT

A shock absorbing shoulder strap for use in carrying bags and other items over one's shoulder which is particularly suitable for use on golf bags to absorb the shock of the rising and falling of the bag and its contents on the carrier's shoulder to prevent fatigue. The shoulder strap includes an inelastic body portion adapted to rest on the carrier's shoulder, a first adjustable elastic strap secured to one end of the body portion, a second adjustable elastic strap secured to the other end of the body portion, and releasable snap buckles carried by the elastic straps for securing the shoulder strap to the bag. As the bag and its contents rise and fall on the carrier's shoulder, the elastic straps contract and expand, absorbing a significant portion of the resulting shock which would otherwise be transmitted directly to the carrier's shoulder. By adjusting the effective length of the elastic straps through buckles carried thereby, the elasticity and length of the shoulder strap can independently varied.

3 Claims, 3 Drawing Sheets

SHOCK ABSORBING SHOULDER STRAP

This is a continuation of application Ser. No. 08/147,332 filed on Nov. 03, 1993, now U.S. Pat. No. 5,450,995.

BACKGROUND OF THE INVENTION

The present invention relates to an improvement in shoulder straps for carrying bags and packs and is particularly well-suited for use with golf bags. Golf bags have a removable shoulder strap which is adjusted to the body of the wearer, cushioned over the shoulder and attached at spaced ends to the bag. Many golf bags are fairly large and when filled with a set of clubs, balls and additional wearing apparel are relatively heavy. As a player carries his or her bag over the course, the bag tends to rise and fall on the player's shoulder as a result of the player's natural gait. As a result, the weight of the bag and its contents appear to become heavier and heavier, fatiguing the player and often adversely affecting his or her play. Even the smaller light weight golf bags when filled with clubs are sufficiently heavy to fatigue many players during a round of golf.

Shoulder supported bags are also used in other sports such as backpacking and hiking. While the contents of such bags are often lighter than golf clubs, the distances traveled and terrain encountered are frequently more challenging. Without any means for absorbing the shock of the bouncing bag on the carrier's shoulder, the weight of these bags and their contents can again become quite unpleasant. It would be highly desirable to provide a shoulder strap mechanism for golf and other shoulder supported bags that effectively absorbs the shock of the bag and its contents as they repeatedly rise and fall on the carrier's shoulder.

Previous attempts to ease the load of carrying such bags have generally entailed cushioning the shoulder strap with soft padding and widening the strap to increase its surface area. While such strap modifications are beneficial in many applications in that they make the strap more comfortable on the shoulder, they do not address the problem of the uneven pressure applied to the shoulder by such bags while being carried. The heavier the bag and its contents and the more irregular the terrain, the more severe is the bouncing and discomfort resulting therefrom. The present invention not only provides a shoulder strap mechanism which is comfortable against the shoulder but which will also absorb a significant amount of the shock of the bouncing bag and items therein which would otherwise be transmitted directly to the carrier's shoulder.

SUMMARY OF THE INVENTION

It is the principal object of the present invention to provide an improved adjustable shoulder strap for carrying golf bags which reduces the strain on the shoulder of the carrier during use.

It is another object of the present invention to provide an adjustable shock absorbing shoulder strap for use on a wide variety of carrying bags adapted to be supported by the shoulder of the carrier which reduces the strain on the shoulder during use.

It is a still further object of the present invention to provide an adjustable shock absorbing shoulder strap for use on golf and other carrying bags adapted to be supported by the shoulder of the carrier which is of simple construction and economical to manufacture.

These and other objects and advantages of the present invention are preferably accomplished by providing a readily adjustable shoulder strap for such bags which is cushioned on its underside where it contacts the user's shoulder, has snap buckles at each end thereof for removably attaching the strap to the bag, and is provided with resilient expansible members interposed between each snap buckle and the extended ends of the strap body. As the bag and its contents rise and fall on the carrier's shoulder, the resilient expansible members expand and contract and thereby effectively absorb a significant portion of the shock which would otherwise be exerted directly on the carrier's shoulder.

IN THE DRAWINGS

DESCRIPTION OF THE PREFERRED EMBODIMENTS

Figure 1:
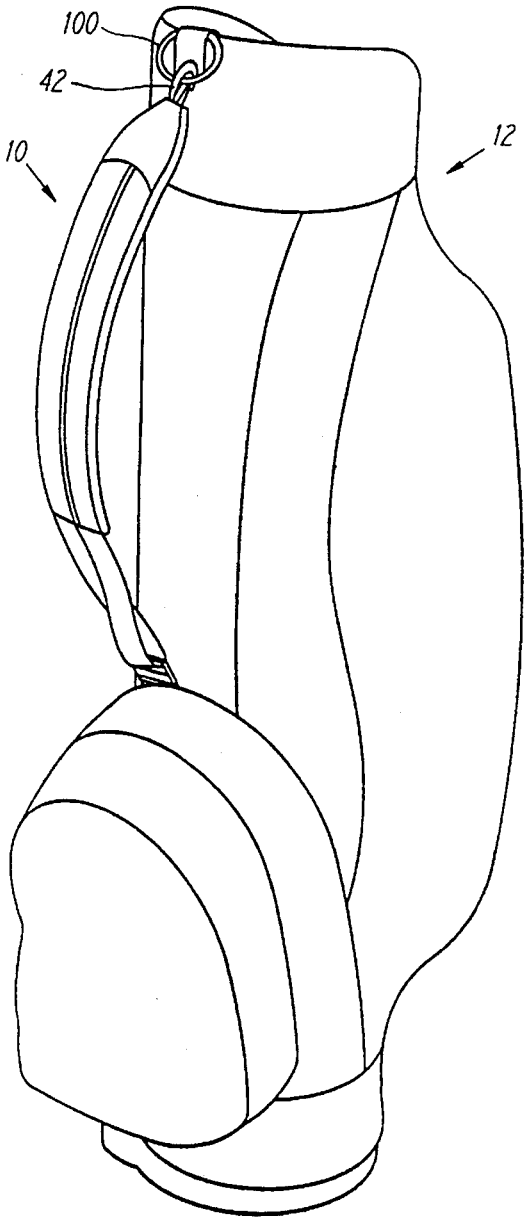
FIG. 1 is a perspective view of a golf bag with the shock absorbing shoulder strap of the present invention attached thereto.
Figure 2:
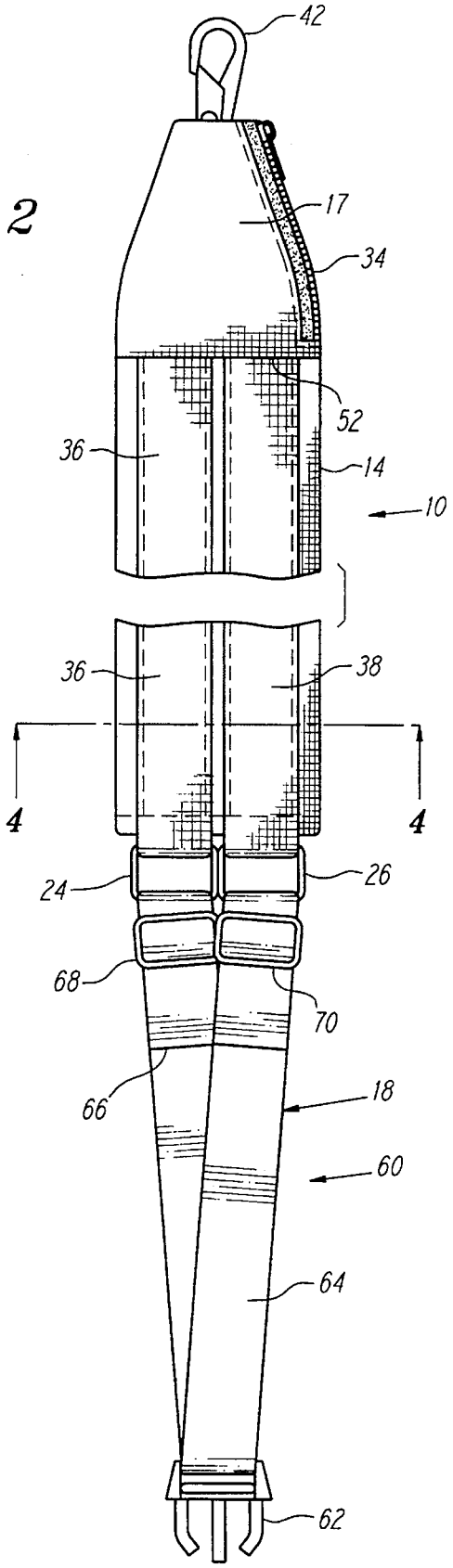
FIG. 2 is a front elevational view of the shoulder strap of FIG. 1 shown removed from the bag.
Figure 3:
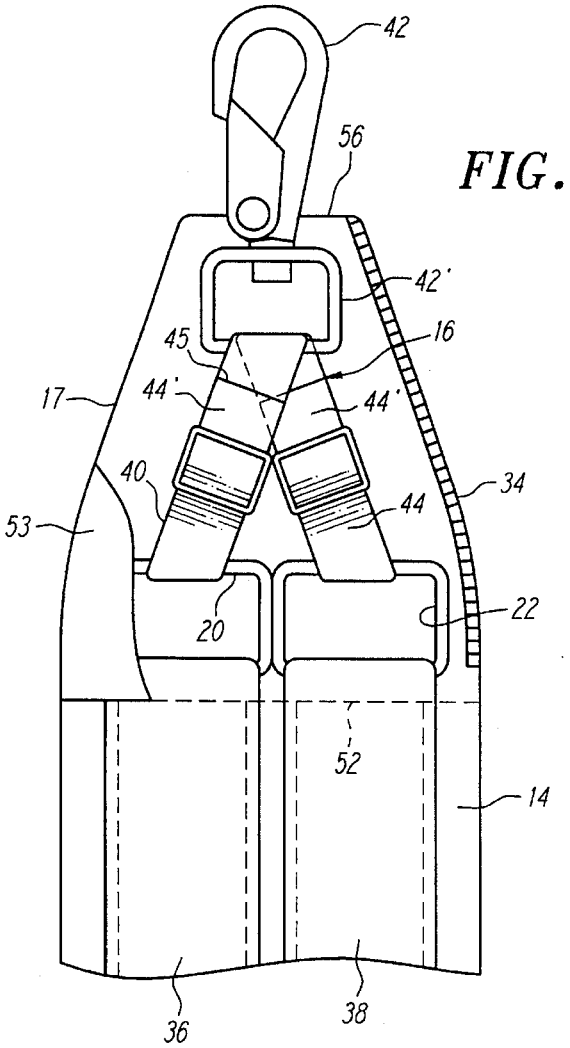
FIG. 3 is a partial front elevational view of the upper end of the shoulder strap of FIGS. 1–2 with a portion thereof broken away to show the configuration and attachment of the upper elastic strap assembly.

Referring now in detail to the drawings, a first embodiment of a shoulder strap 10 of the present invention is illustrated in FIG. 1 attached to a conventional golf bag 12. This embodiment of the present invention is particularly adapted for use in the larger and heavier bags such as the pro or tour-type golf bag. As seen in FIGS. 2 and 3, the shock absorbing shoulder strap 10 is comprised of an inelastic elongated main body portion 14, an adjustable upper elastic strap assembly 16, preferably disposed within a protective cover 17, and an adjustable lower elastic strap assembly 18. The main body portion 14 of shoulder strap 10 is preferably padded and carries a first pair of adjacently disposed attachment rings 20 and 22 at its upper end for the securement thereto of the upper elastic strap assembly 16, and a second pair of adjacently disposed attachment rings 24 and 26 at its lower end for the securement thereto of the lower elastic strap assembly 18.

Figure 4:
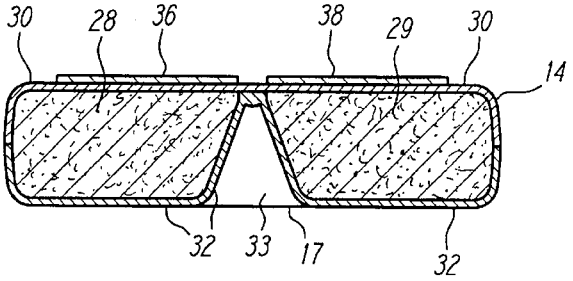
FIG. 4 is a sectional view taken along the line 4—4 in FIG. 2.

In its preferred configuration, the main body portion 14 of shoulder strap 10 comprises of a pair of elongated compressible foam members 28 and 29 (see FIG. 4) which are encased in parallel alignment between and separated by an outer cover layer 30, preferably of a nylon material, and inner cover layer 32, preferably of a tacky vinyl material such as that marketed under the name Tough Tek by Harrison Technologies of Johnstown, N.Y. The inner and outer layers of material 30 and 32 are sewn or stitched together about and between foam members 28 and 29, as seen in FIG. 4, defining a longitudinal channel 33 in the inner surface of the strap body portion 14. A pair of inelastic nylon straps 36 and 38 are stitched onto the outer nylon layer 30 such that they extend parallel to foam members 28 and 29. The upper ends of inelastic straps 36 and 38 are looped about and secured to the lower portions of upper attachments rings 20 and 22 (see FIG. 3). The lower ends of straps 36 and 38 are looped about and secured to the upper portions of lower attachment rings 24 and 26 (see FIG. 2). Through such a construction, a durable yet comfortable inelastic main body portion is provided for shoulder strap 10 which, due to the layer 32 of the tacking vinyl material and longitudinal channel 33 formed in the inner side of body portion 14, is highly resistant to lateral slippage on the carrier's shoulder during use. If desired, however, the inner layer 32 of material covering foam elements 28 and 29 could be formed of a soft natural or synthetic fur material without impairing the shock absorbing characteristics of the shoulder strap 10. Other configurations of inelastic main body portions could also be employed in strap 10 without adversely affecting shock absorbing characteristics of the strap.

As shown in FIGS. 1 and 3, the upper elastic strap assembly 16 comprises a resilient expansible means 40 which is secured to the upper end of the main body portion 14 of the strap via attachment loops 20 and 22 and is releasably attached to the strap ring 100 on golf bag 12 by a conventional snap buckle 42 carried by means 40. In the preferred configuration of shoulder strap 10, the resilient expansible means 40 is defined by a single elongated elastic strap 44 and a pair of adjustment buckles 46 and 48.

Figure 5:
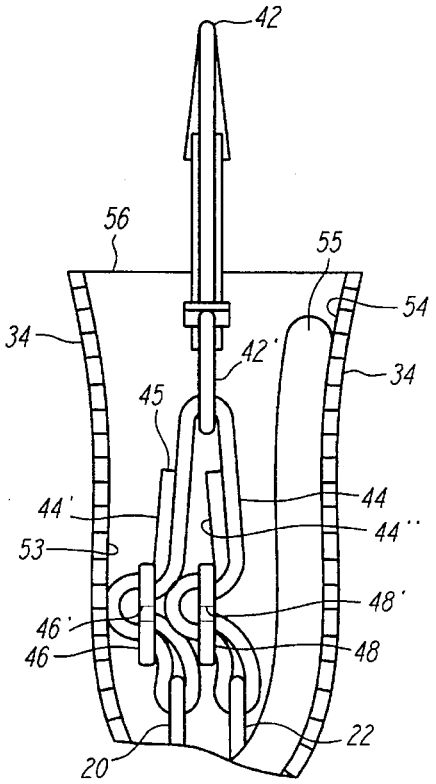
FIG. 5 is a side view of the upper end of the shoulder strap of FIGS. 1–4 showing the padded cover open along one side thereof and portions of the elastic strap therein offset to illustrate the mounting of the adjustment buckles on the strap.

The preferred configuration of upper strap assembly 16 is shown in FIGS. 3 and 5. As will be discussed later herein, the protective cover 17 in which strap assembly 16 is disposed is provided with a zipper 34 along one side thereof to provide access to the strap assembly. In FIG. 5, cover 17 is shown in an open disposition and the portions of elastic strap 44 extending to and from snap buckle 42 are illustrated as being vertically offset for explanation purposes only. In fact, said portions lie substantially in a common plane. As seen in FIG. 5 strap 44 is threaded from one end 45 thereof downwardly through an adjustment buckle 46, about the upper portion of upper attachment ring 20 and extends upwardly back through buckle 46 and the base 42' of snap buckle 42. Strap 44 extends downwardly from snap buckle 42, passing through the backside of a second adjustment buckle 48, about the attachment ring 22 and back through adjustment buckle 48. Such an assembly provides a detachable elastic securement of the upper end of the shoulder strap 10 to the golf bag 12 and, through adjustment buckles 46 and 48, allows the elastic strap 44 to be replaced in the event it were to loose its elasticity with age without having to replace the entire strap 10. As will be discussed later herein, elastic strap assembly 16 also provides a means for adjusting the effective length of elastic scrap 44 to vary the spring characteristics of the shoulder strap 10 for differently weighted loads.

The protective cover 17 for the upper strap assembly 16 is preferably of a tapered configuration and stitched onto the upper end of the body portion 14 of the shoulder strap 10 along seam 52 and about nylon straps 36 and 38 such that the upper ends of straps 36 and 38 and the attachment rings 20 and 22 secured thereto are disposed within the lower portion of cover 17. Cover 17, like body portion 14, has an outer nylon surface 53, an inner surface 54 of a tacky vinyl or soft fur material and a truncated cone-shaped foam element 55 secured to the interior side of the cover's inner surface by a suitable adhesive. An opening 56 is formed in the upper end of cover 17 to allow the snap buckle 42 and a portion of elastic strap 44 to extend therethrough. A zipper 34 is provided along side of cover 17 to provide easy access to the strap assembly 16 therein for adjustment or replacement. Cover 17 thus extends the padded area of the shoulder strap and protects the upper elastic strap assembly 16 while providing access thereto.

Figure 6:
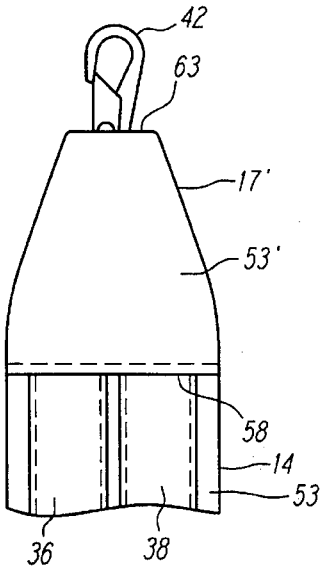
FIG. 6 is a partial front elevational view of a modification of the upper elastic strap assembly cover.

A modification of the protective cover 17 is shown in FIG. 6 wherein the access zipper 34 is eliminated, the inner surface of the cover is simply a continuation of the inner cover layer 32 of the main body portion 14 of the strap, and the lower end 58 of the outer nylon surface 53' of the of the modified cover 17' is neither stitched nor otherwise attached to the upper end of the main body portion 14 of the strap such that cover 17' forms a pocket open along its lower outer end 58. The upper end of cover 17' has an opening 63 therein so that the snap buckle 42 and a portion of elastic strap 44 can extend therethrough. In this embodiment, the upper elastic strap assembly 16 is simply pulled out of cover 17' through its open lower end 59 for replacement or adjustment.

The lower elastic strap assembly 18 also comprises a resilient expansible means 60 which is secured to the lower end of the main body portion 14 of strap 10 via attachment rings 24 and 26 and is releasably attached to a quick release snap buckle on the golf bag 12 by a matting buckle 62 carried by means 60. In the preferred configuration of shoulder strap 10, the resilient expansible means 60 comprises a single elastic strap 64, which is greater in length than the upper elastic strap 44, and a pair of adjustment buckles 68 and 70. Strap 64 is threaded from one end 66 thereof upwardly through adjustment buckle 68, about the lower portion of lower attachment ring 24 and back down through the rear side of buckle 68. Strap 64 then extends downwardly from buckle 68 and through the base of quick release snap buckle 62. From buckle 62, strap 64 extends upwardly through adjustment buckle 70, about attachment ring 26 and back down through buckle 70. Such an assembly provides a removable securement of the lower end of the shoulder strap 10 to the golf bag by means of the quick release buckle 62 and, by means of adjustment buckles means 68 and 70, not only allows elastic strap 64 to be readily replaced, but also allows the overall length of the shoulder strap 10 to be easily adjusted to accommodate the desired bag carrying angle as well as differences in the physical size of the carriers.

By virtue of the resilient and expansible characteristics of elastic straps 44 and 64 disposed proximate the upper and lower points of attachment of shoulder strap 10 to the golf bag 12, the shock to the shoulder of the bag carrier generated by the repeated bouncing of the bag and its contents thereon is substantially absorbed by the shoulder strap 10 as opposed to being transmitted directly to the carrier's shoulder. As the bag moves up and down, the elasticity in straps 44 and 64 causes the straps to contract and expand accordingly, effectively transmitting a portion of the load to the elastic straps. It has been found that to effectively absorb the energy of the rising and falling of the bag, it is necessary to dispose a resilient expansible member such as elastic straps 44 and 64 at both the upper and lower ends of shoulder strap 10.

Because a golf bag is carried on one's shoulder at an angle, the majority of energy absorption in shoulder strap 10 occurs in the upper end thereof through elastic strap 44. While increasing the length of strap 44 would increase the capability of strap to expand and further reduce the shock to the shoulder for heavy bag loads, elongating elastic strap 44 would extend the elastic strap into the main body portion 14. However, the relatively steep angle at which golf bags are often carried necessitates extending the padded body portion of the strap to a point proximate the upper end of the shoulder strap. Unless a suitable encasement were provided for such an extended elastic strap within the main body portion 14, an undesirable pinching effect would be created on the padded main body portion 14 by the expanding and contradicting of the strap herein. This pinching effect would be transmitted to the carrier's shoulder causing discomfort. With the compact adjustable loop configuration of elastic strap assembly 16 and by forming strap 44 of a suitable polyester elastic webbing, shoulder strap 10 is provided with excellent energy absorbing characteristics for most large bag applications without having to shorten the padded body portion of the strap or provide a strap encasement within the body portion. A suitable webbing for elastic strap 44 is a one inch wide heavy duty webbing comprised of polyester and cotton yarn and rubber thread marketed by Thomas Taylor and Sons, Incorporated of Hudson, Mass. under the registered trademark "Shugor", pattern no. 28407.

In the preferred configuration of shoulder strap 10 and as shown in the drawings, strap 64 is formed of the same elastic webbing material as strap 44 but is about 1.5 inches in width. By using the above-described heavy duty elastic webbing, a single relatively narrow elastic strap 44 can be employed in the upper elastic strap assembly 16 which not only provides adequate energy absorption for even the relatively heavy tour bags, but allows the assembly 16 to be readily disposed within a relatively flat tapered and padded cover 17 having a transverse dimension no greater than the width of the main body portion 14 of the shoulder strap. The use of the wider elastic strap 64 in the lower elastic strap assembly 18, and the correspondingly larger adjustment buckles 68 and 70, while not necessary to provide adequate shock absorption, is believed to be easier to adjust for many people and provides the shoulder strap 10 with a more attractive appearance.

The configuration of elastic strap assembly 16 also allows for the spring characteristics of elastic strap 44 to be adjusted should the carrier so desire. Elastic strap 44 is preferably of sufficient length to leave end portions 44' and 44" extending from adjustment buckles 46 and 48, so that the longitudinal spacing between snap buckle 42 and the adjustment buckles 46 and 48 can be increased or otherwise adjusted. Because of the configuration of elastic strap assembly 16, only the portion of elastic strap 44 extending from the cross bar 46' of adjustment buckle 46, through the base 42' of snap buckle 42 to the cross bar 48' of buckle 48 can stretch under the load of the golf bag and its contents. The remainder of strap 44 is not under load. With a typical longitudinal spacing between base 42' and cross bars 46' and 48' in shoulder strap 10 of only about 1.5 inches, providing extended end portions 44' and 44" of only one inch in length will allow this longitudinal spacing to be increased by 66%. This provides for a substantial increase in the expansibility of the strap and thereby substantially increase the ability of shoulder strap 10 to absorb heavier loads without appreciably changing the overall length of shoulder strap 10. In fact, any such increase in the overall shoulder strap length could be offset entirely by a corresponding reduction in the length strap 64 in the adjustable lower elastic strap 18 assembly by means of adjustment buckles 68 and 70. As the expansible portion of elastic strap 64 is substantially longer than that of strap 44, such an offsetting adjustment would not cause any noticeable reduction in the increased shock absorption capability of shoulder strap 10. Thus, the elongated lower elastic strap assembly 18 allows the overall length of the shoulder strap to be readily adjusted for differently sized individuals and different preferred bag carrying angles without affecting the elastic characteristics of the shoulder strap, while the upper compact elastic strap assembly 16 provides for adjustment in the expansibility of the shoulder strap.

Figure 8:
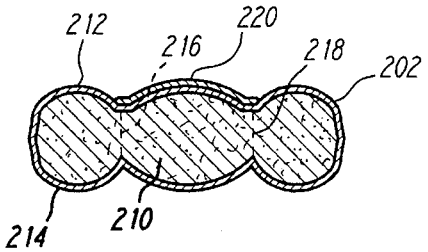
FIG. 8 is a sectional view taken along the line 8—8 of FIG. 7.
Figure 7:
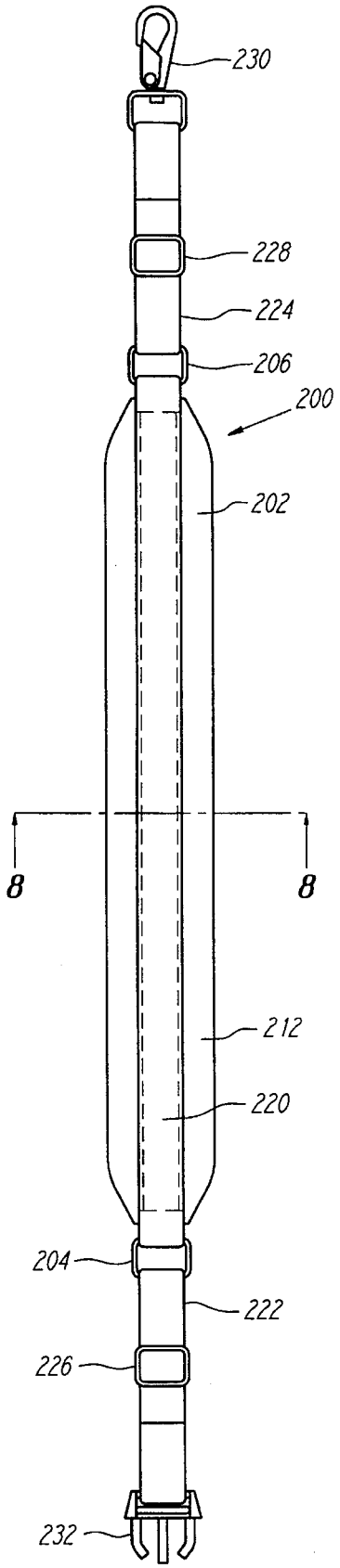
FIG. 7 is a front elevational view of an alternate embodiment of the shoulder strap of the present invention.

An alternate embodiment of the shock absorbing shoulder strap of present invention is shown in FIG. 7. Shoulder strap 200 is particularly adapted for use with smaller and lighter weight golf bags than the prior embodiment of strap 10 shown in FIGS. 1–5. Strap 200 has a main body portion 202 which is essentially of the same construction as body portion 14 of the prior embodiment, but somewhat narrower. Body portion 202 is preferably padded or cushioned and, terminates at its upper end in attachment ring 204 and at its lower end in ring 206. In the preferred configuration of body portion 202, a foam member 210 is disposed between an outer cover layer 212 of nylon material and an inner cover layer 214 of a tacky vinyl material. The inner and outer layers 212 and 214 are stitched together about foam member 210 and along longitudinal lines 216 and 218 to provide the channeled configuration shown in FIG. 8. If desired, a length of natural or synthetic fur material could be used to form the inner cover layer 214. A single inelastic nylon strap 220 is stitched onto the outer cover layer 212 as seen in FIGS. 7 and 8. The extended ends of strap 220 are sewn about or otherwise secured to attachment rings 204 and 206. Rings 204 and 206 are respectively coupled to elongated elastic straps 222 and 224, preferably formed of the same polyester elastic webbing and of the same width as elastic strap 64 of the prior embodiment. Elastic straps 222 and 224 are each threaded through an adjustment buckle 226 and 228, respectively, disposed intermediary of their ends. Upper elastic strap 224 also extends through the base portion of a snap buckle 230 to detachably secure the upper end of shoulder strap 200 to an attachment ring on a golf bag. The lower elastic strap 222 extends through the base portion of a quick release snap buckle 232 to detachably secure the lower end of strap 200 to a mating quick release buckle on the golf bag. This embodiment of the invention also provides the same adjustability in overall length via lower elastic strap 222 and buckle 226 and in the expansibility via upper elastic strap 224 and buckle 228 as the prior embodiment.

Figure 9:
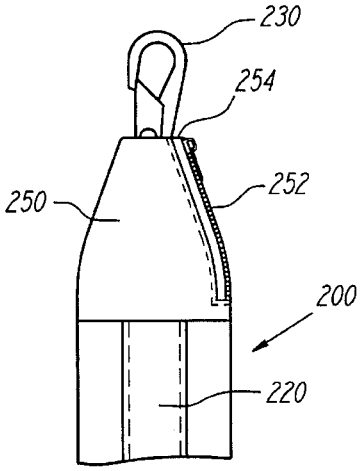
FIG. 9 is a partial front elevational view of a modification of the shoulder strap of FIG. 7.

FIG. 9 illustrates a modification of the upper portion of strap 200 wherein the upper elastic strap (not shown) is shortened and provided with a padded cover 250. Cover 250, like covers 17 and 17' discussed earlier herein, is preferably comprised of the same materials as the main body portion 202 of strap 200, and could be constructed in the same manner as covers 17 or 17'. In the embodiment of cover 250 shown in FIG. 9, the cover is stitched onto the upper end of the main body portion, is provided with a side access zipper 252 and an open upper end 254 so that elastic strap 224 and snap buckle 230 can protrude from the padded cover 250 during use. In the normal unextended position, only the snap buckle 230 protrudes from the cover thereby providing a more aesthetic appearance for the upper end of the strap.

While the preferred embodiments of the shock absorbing shoulder strap described above have employed a single elastic strap formed of polyester elastic webbing as the upper and lower resilient expandable means and are specifically designed for use on golf bags, it is to be understood that the present invention is not so limited. Other suitable resilient expansible materials could be employed and the shoulder strap of present invention is not limited to golf bags. It could be employed on a wide variety of bags and other equipment supported by one's shoulders such as equipment bags, back packs and leaf blowers. While shoulder straps embodying the present invention designed for such applications might vary somewhat in length and configuration for their particular applications, each such strap would employ a non-expansible body portion adopted to rest against the user's shoulder and a resilient expansible member extending between each of the ends of the body portion and the item being carried by the strap. Various means for adjusting the length of the shoulder strap could also be employed. These and other changes and modifications may be made in carrying out the present invention without departing from the spirit and scope thereof. Insofar as these changes and modifications are within the purview of the appended claims, they are to be considered as part of the present invention.

I claim:

1. A shock-absorbing shoulder strap for use in carrying an item over one's shoulder, said strap comprising:

an inelastic body portion adapted to rest on one's shoulder during use and defining a first end, a second end, an inner surface and an outer surface and comprising a length of compressible foam material encased between an outer layer of material and an inner layer of material, said inner layer of material being a tacky vinyl, an inelastic strap secured to said outer layer of material and defining extended strap ends, and stitching extending between said inner and outer lengths of material so as to define at least one longitudinally extending channel in said inner surface of said body portion to prevent lateral slippage of said shoulder strap on one's shoulder;

a first elastic strap member;

a first coupling secured to and extending between said first elastic strap member and one of said ends of said inelastic strap;

a second elastic strap member;

a second coupling secured to and extending between said second elastic strap member and the other of said ends of said inelastic strap;

a first means for releasibly attaching said first elastic strap member to the item at a first location thereon; and a second means for releasibly attaching said second elastic strap member to said item at a second location thereon, said second location being spaced from said first location.

2. A shock-absorbing shoulder strap for use in carrying an item over one's shoulder, said strap comprising:

an inelastic body portion adapted to rest on one's shoulder during use defining an inner surface and an outer surface and comprising an elongated cushioning pad adjacent said inner surface and an inelastic strap secured to said pad adjacent said outer surface, said inelastic strap defining extended ends;

a first elastic strap member axially aligned with said body portion;

a first coupling secured to and extending between said first elastic strap member and a first end of said inelastic strap on said body portion;

a second elastic strap member axially aligned with said body portion;

a second coupling secured to and extending between said second elastic strap member and a second end of said inelastic strap on said body portion;

a first means for attaching said first elastic strap member to the item at a first location thereon; and a second means for releasibly attaching said second elastic strap member to said item at a second location thereon, said second location being spaced from said first location.

3. The shoulder strap of claim 2 including an adjustment buckle carried by at least one of said elastic strap members for adjusting the length of said member between one of said couplings and one said attaching means whereby the elasticity of the elastic strap member can be varied.

* * * * *